US005289938A

United States Patent [19]

Sanchez

[11] Patent Number: 5,289,938

[45] Date of Patent: Mar. 1, 1994

[54] RIM STRUCTURE FOR METAL CONTAINER

[76] Inventor: Purificación A. Sanchez, Plaza Josep Rigol, 8, 08760 Martorell Province of Barcelona, Spain

[21] Appl. No.: 9,051

[22] Filed: Jan. 26, 1993

[51] Int. Cl.[5] ..... B65D 39/00

[52] U.S. Cl. ..... 220/307; 220/656

[58] Field of Search ..... 220/306, 307, 308, 656, 220/657, 658, 660

[56] References Cited

U.S. PATENT DOCUMENTS 4,513,872 4/1985 Bull ..... 220/658

4,865,212 9/1989 Bravo .

*Primary Examiner*—Allan N. Shoap

*Assistant Examiner*—Nova Stucker

*Attorney, Agent, or Firm*—Flynn, Thiel, Boutell & Tanis

[57] ABSTRACT

A rim structure for a metal container wherein the rim is an integral part of the container cylindrical sidewall. The rim has an outwardly projecting wall which is radially inwardly folded by a top fold over onto itself and is then vertically folded upwardly and thereafter radially outwardly folded to define a generally triangle-shaped cross section. The top of the triangle is extended above the top fold. This configuration defines an internal step at the mouth of the container, its top portion is flexible due to the free outwardly deflection of the vertically internal length determining the step. This resiliency allows an annular projection on the container lid to be snap-fitted through the step.

5 Claims, 1 Drawing Sheet

RIM STRUCTURE FOR METAL CONTAINER

FIELD OF THE INVENTION

The present invention relates to a rim structure for defining the mouth or opening of a metal container.

BACKGROUND OF THE INVENTION

From U.S. Pat. No. 4,865,212 there is disclosed a rim structure for a metal container having a rim that is an integral part of the container cylindrical sidewall. One of the drawbacks of this known rim is that the rim has not enough rigidity in the container mouth, and any accidental fall or dropping of a full container may cause the lid to be opened because the mouth may be detrimentally strained.

With the rim structure of the present invention, more compact rigidity in the container mouth is obtained which is only comparable to that achieved by conventional rims which are separately produced and which must then be separately secured to the edge of the container sidewall using a special operation. However, the rim structure of this invention preserves the low-cost advantages provided when the rim is incorporated to the container in a single operation.

Additionally, with the rim structure of the present invention, due to the particular rim configuration provided, a more specific lid airtight seal and a better lid holding in its sealing position is obtained so as to better resist blows or drops which might tend to cause accidental opening.

Lastly, with the improved rim structure all of the rim outside visible portions have the same finished appearance as that of the container sidewall, thereby giving the rim an improved aesthetic appearance relative to most known metal containers. Most known metal containers are generally provided with an appearance or rim color quite different to that of the container external walls due to these components being separately made.

In the mouth of the container of this invention, rigidity is provided by specific edge bending of the container sidewall making up the rim and shaped by an outwardly projecting length with a tilt of about 45°, this length being radially inwardly folded over onto itself and then vertically upwardly raised and radially outwardly folded to define a generally triangle-shaped cross section. The top free end of the triangle is extended according to a vertically upwardly short length, being afterwards inwardly folded over onto itself so that a rounded edge can be shaped.

This peculiar configuration determines an internal step close to the mouth, its top portion being flexible or resilient, and this resiliency being provided by the free outwardly deflection of the vertically internal length determining said step. This resiliency allows an annular projection, as provided on the container lid outside sidewall, to be snap-fitted through the step length, with the projection snapping under the stepping edge and being then fixed to create a highly resistant snap-fit against accidental opening.

DETAILED DESCRIPTION

Figure 2:
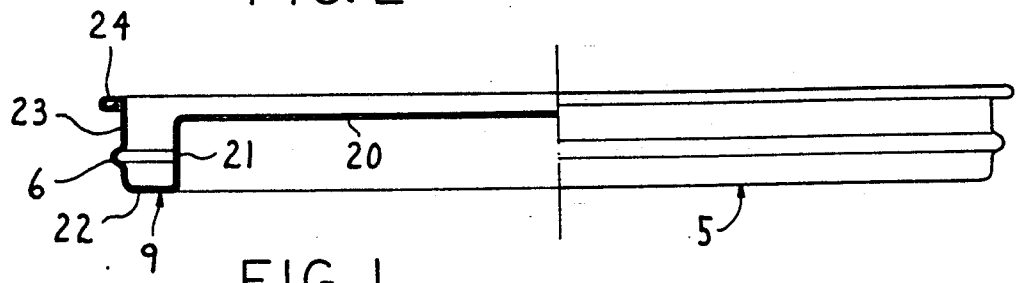
FIG. 2 is a fragmentary cross-sectional view of the lid of the container.
Figure 1:
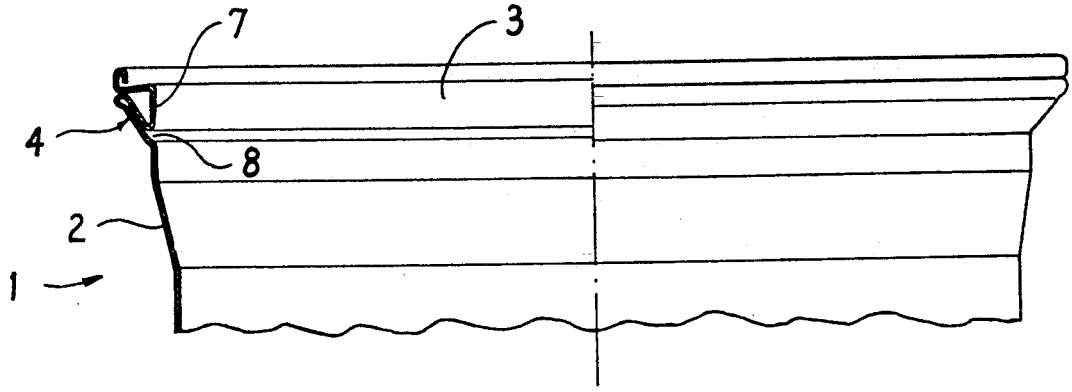
FIG. 1 is a fragmentary cross-sectional view through the rim of a container according to the present invention.
Figure 3:
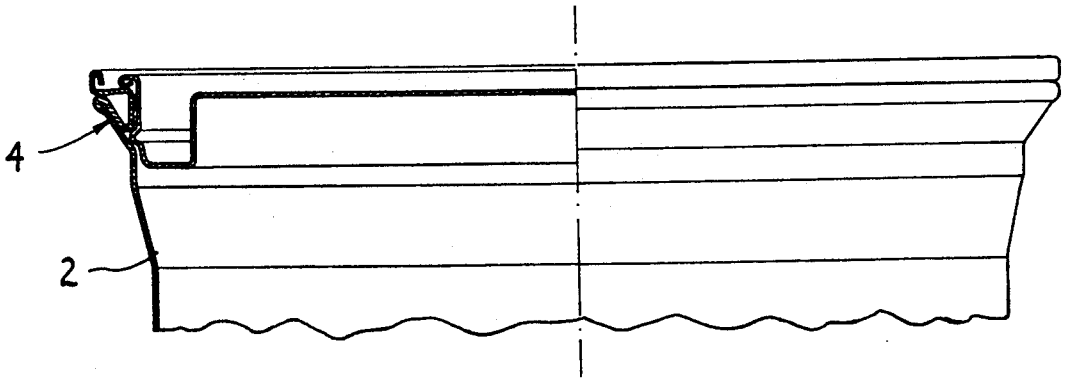
FIG. 3 is a similar view showing the lid in a sealing position on the container.

The drawings show a cylindrical metal container 1 having a cylindrical sidewall 2 and defining an opening or mouth 3 at one end thereof, which opening is surrounded by an annular rim 4 which is designed to receive the annular flange of a removable lid or cover 5 provided with an annular projection 6 to create a hermetic seal.

The V-shaped configuration of the rim 4 allowed its length 7 to be outwardly radially deflected and a smooth insertion, however snap-fitted, of the rib or projection of the lid 5 and its pressurized engagement at the stepping 8.

The rim structure 4 projects upwardly from and is integrally joined to the upper end of the cylindrical sidewall 2 at plane 10, and includes an annular wall part 11 which diverges or flares outwardly, such as at an angle of about 45°, as it projects upwardly from the upper end of the cylindrical sidewall 2. This diverging annular wall part 11 resembles a truncated conical configuration. The diverging wall part 11, at its upper end, is folded over radially inwardly onto itself to form a rounded annular outer top flange 12 which has an outwardly rounded cross section, and which then extends downwardly inside the exterior wall part 11 so as to define a further inclined annular flange 13 which is generally straight and which converges inwardly as it projects axially downwardly in closely adjacent and approximately parallel relationship with the outer wall part 11.

The inclined flange 13 projects axially downwardly and radially inwardly so that the lower end of this flange is positioned in a horizontal plane which is adjacent but spaced slightly upwardly from the location or plane 10 where the exterior wall part 11 merges into the adjacent upper end portion of the cylindrical sidewall 2. At its lower end, the flange 13 is folded over radially inwardly onto itself to define a generally V-shaped annular fold 14 which is tightly rounded at the bottom and which opens upwardly.

The fold 14 and its slight axial upward spacing from the location or plane 10 results in creation of the shallow annular step or groove 8 disposed in surrounding relationship to the rim adjacent the upper end of the cylindrical sidewall 2, which groove 8 opens radially inwardly of the rim.

The fold 14 joins to an annular vertical flange 15 which projects axially upwardly so as to be substantially straight and substantially parallel with the longitudinal (i.e., vertical) axis of the container. This annular flange 15 defines the mouth or opening 3 of the container. The inner surface of this flange 15 is substantially coaxially aligned with the inner surface of the upper and adjacent part of the cylindrical sidewall 2, and has a diameter which approximately equals the inner diameter of the container as defined by the adjacent upper portion of the cylindrical sidewall 2.

The vertical flange 15, at its top or axially outer end, is folded over radially outwardly by a fold or bend 17 which is about a 90° bend and joins to an annular top flange 18 which projects radially outwardly from the bend 17, with this top flange 18 projecting outwardly adjacent but generally axially over the fold 12. The radially outer edge of top flange 18 in turn is folded upwardly and radially over onto itself to form a rounded annular outer top flange 19 of generally rounded cross section, which top flange 19 terminates in a free edge. This top flange 19 is disposed closely adjacent and is generally disposed axially directly over the fold 12.

Figure 4:
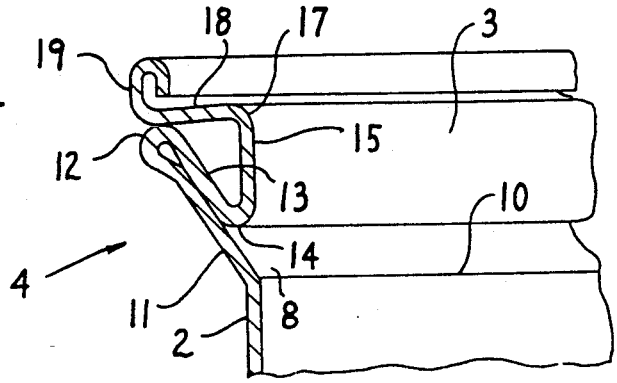
FIG. 4 is an enlarged, fragmentary cross-sectional view through the rim.

As described above, and as illustrated by FIG. 4, the flanges or wall parts 13 and 15 and their connection by the fold 14 defines a generally V-shaped arrangement which, in conjunction with the projection of the top flange 18 outwardly over the top of the fold 12, enables the vertical flange or wall 15 to be resiliently deflected radially outwardly so as to resiliently accommodate the insertion or removal of the lid.

As described above, and as shown in the drawings, the entire rim arrangement 4 is formed integrally with the thin sheetlike metal material defining the cylindrical sidewall 2 so that the rim arrangement 4 and sidewall 2 are of an integral one-piece structure all formed from thin sheetlike material of substantially uniform thickness.

As to the lid 5, it includes a central generally flat cover portion 20 having the annular mounting flange 9 extending circumferentially therearound. This flange 9, in the illustrated embodiment, is of a generally upwardly-opening U-shaped cross section including an inner annular wall 21 which projects downwardly from the central cover 20. This inner annular wall 21 at its lower end is bent outwardly to define an annular bottom wall 22, and the bottom wall 22 at its radially outer edge is bent upwardly so as to define the upwardly projecting outer annular wall 23. This latter wall 23 projects upwardly in cantilevered relation and has the upper edge thereof folded outwardly and downwardly to form a rounded fold 24 at its upper and outer free edge. The outer annular wall 23 of the lid flange also has the bead-like annular projection 6 formed therein, which projection 6 projects radially outwardly from wall 23 and extends annularly thereof.

With the arrangement of the present invention as described above, the flange 9 on the lid 5 is inserted into the mouth 3 defined by the rim structure 4. During this insertion, the sealing projection 6 on the lid flange cams against the annular flange wall 15 of the rim and causes radially outward resilient reflection until the sealing projections 6 snaps into the annular groove 8, whereupon the rim structure resilient returns to its original position and creates a resilient but releasable holding of the lid on the container. The snug engagement of the lid flange within the mouth opening defined by the rim structure, and the snug engagement of the sealing projection 6 within the groove 16, define a generally hermetically sealed engagement between the lid and container, and provide an airtight seal and a secure holding of the lid so as to better resist accidental dislodgement of the lid due to dropping of the container and the like. At the same time, the rim structure of the container is sturdy and provides a desired compactness which facilitates effective sealing of the lid.

Also, the manner in which the rim is formed on the container is such that the finished appearance of the container remains smoothly and ecstatically pleasing without requiring any additional treatments so as to equalize or disguise the rim structure, whereby the container has a better overall appearance when such is deemed necessary or desirable.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a metal container having a generally cylindrical sidewall terminating at its upper end in an annular rim structure which surrounds and defines an opening into the container and a removable lid, the rim structure of said cylindrical sidewall being adapted to sealingly engage said removable lid, the rim structure in its entirety being formed integrally with said cylindrical sidewall by being formed from the same thin material used for forming the cylindrical sidewall, comprising the improvement wherein:

the cylindrical sidewall of the container in the vicinity of the upper end thereof has an integral outer wall part which diverges radially outwardly as it projects axially upwardly, said outer wall part at its upper end being folded radially inwardly over onto itself to define an annular outer flange having a rounded cross section, said outer flange at its radially inner end having an intermediate inclined flange extending axially downwardly while converging radially inwardly from said upper end, said intermediate inclined flange being generally straight as it inclines downwardly so as to terminate at its lower end in a generally V-shaped fold which opens axially upwardly and defines an annular vertical flange which in turn defines said opening, the diameter of said opening as defined by said annular vertical flange being substantially equal to the inside diameter of said cylindrical sidewall at the upper end thereof where said sidewall joins to said outer wall part, said annular vertical flange projecting axially upwardly in straight and generally parallel relationship with the longitudinal axis of the container, said vertical flange at its upper end being bent radially outwardly to define a radially outwardly projecting annular top flange which projects radially outwardly and is provided with a rolled outer flange adjacent a radially outer free edge thereof, said top flange and said rolled outer flange being positioned axially above said annular outer flange, said V-shaped fold and the upper end of the cylindrical sidewall being slightly axially spaced apart and defining a shallow radially-outwardly projecting annular groove therebetween, said annular groove opening inwardly into said opening, and said lid removably engaged with said rim structure for closing off said opening, said lid including an annular flange which projects into the opening for disposition inside said vertical annular wall, said annular flange on said lid having a radially outwardly projecting surrounding annular projection which creates a resilient snap-fit within said groove.

2. In a metal container having a generally cylindrical sidewall terminating at its upper end in an annular rim structure which surrounds and defines a mouth which opens into the container, the rim structure being adapted to sealingly engage a removable lid, the rim structure in its entirety being formed integrally with said cylindrical sidewall by being formed from the same thin material used for forming the cylindrical sidewall, comprising the improvement wherein:

the cylindrical sidewall of the container in the vicinity of the upper end thereof has an integral outer wall part which diverges radially outwardly as it projects axially upwardly, said outer wall part at its upper end being folded radially inwardly over onto itself to define an annular outer flange having a rounded cross section, said outer flange at its radially inner end having an intermediate inclined flange extending axially downwardly while converging radially inwardly from said upper end, said intermediate inclined flange being generally straight as it inclines downwardly so as to terminate at its lower end in a generally V-shaped fold which opens axially upwardly and defines an annular vertical flange which in turn defines said mouth, said annular vertical flange projecting axially upwardly in straight and generally parallel relationship with the longitudinal axis of the container, said vertical flange at its upper end being bent radially outwardly to define a radially outwardly projecting annular top flange which projects radially outwardly so as to be positioned axially above said annular outer flange, said V-shaped fold and the upper end of the cylindrical sidewall being axially spaced apart and defining a radially outwardly projecting annular step beneath said V-shaped fold.

3. A container according to claim 2, wherein the diameter of said mouth as defined by said annular vertical flange is substantially equal to the inside diameter of said cylindrical sidewall at the upper end thereof where said sidewall joins to said outer wall part.

4. A container according to claim 2, including a lid removably engaged with said rim structure for closing off said mouth, said lid including an annular flange which projects into the mouth for disposition inside said vertical annular wall, said annular flange on said lid having a radially outwardly projecting surrounding annular projection which creates a resilient snap-fit under said step.

5. A container according to claim 4, wherein the diameter of said mouth as defined by said annular vertical flange is substantially equal to the inside diameter of said cylindrical sidewall at the upper end thereof where said sidewall joins to said outer wall part.

* * * * *